United States Patent [19]

Yagi et al.

[11] Patent Number: 4,944,959

[45] Date of Patent: Jul. 31, 1990

[54] PROCESS FOR ELECTROSTATIC RECORDING COMPRISING CHARGING DIELECTRIC SHEET TO POLARITY OPPOSITE OF IMAGING CHARGE

[75] Inventors: Hisanori Yagi, Ibaraki; Kousuke Hamada, Amagasaki; Isamu Nakano, Takatsuki; Yoshihiro Nishimura, Amagasaki; Hajime Matsubayashi, Kobe; Hisashi Tani, Kawanishi, all of Japan

[73] Assignee: Kanzaki Paper Manufacturing Company, Limited, Japan

[21] Appl. No.: 399,441

[22] Filed: Aug. 28, 1989

Related U.S. Application Data

[63] Continuation of Ser. No. 124,591, Nov. 24, 1987, abandoned.

[30] Foreign Application Priority Data

| | | | |
|---|---|---|---|
| Nov. 29, 1986 | [JP] | Japan | 61-285251 |
| Dec. 5, 1986 | [JP] | Japan | 61-291367 |
| Dec. 8, 1986 | [JP] | Japan | 61-291894 |
| Mar. 13, 1987 | [JP] | Japan | 62-59771 |
| Mar. 30, 1987 | [JP] | Japan | 62-80816 |
| Jun. 22, 1987 | [JP] | Japan | 62-154901 |

[51] Int. Cl.[5] ..... G03G 13/048

[52] U.S. Cl. ..... 427/14.1; 430/31; 430/52; 430/55

[58] Field of Search ..... 427/14.1; 430/31, 937, 430/942, 983; 346/135.1

[56] References Cited

U.S. PATENT DOCUMENTS

| | | | |
|---|---|---|---|
| 3,657,005 | 4/1972 | Brown, Jr. et al. | 346/135.1 |
| 3,892,887 | 7/1975 | Shibata et al. | 427/121 |
| 4,076,564 | 2/1978 | Fisher | 430/56 X |
| 4,322,486 | 3/1982 | Putter | 430/31 |

*Primary Examiner*—J. David Welsh
*Attorney, Agent, or Firm*—Larson and Taylor

[57] ABSTRACT

Disclosed is an electrostatic recording medium comprising an electroconductive support and as formed thereon a dielectric layer containing an insulating resin and a pigment, said dielectric layer carrying a surface static charge of a polarity opposite to that of a charge to be applied for image formation.

19 Claims, No Drawings

PROCESS FOR ELECTROSTATIC RECORDING COMPRISING CHARGING DIELECTRIC SHEET TO POLARITY OPPOSITE OF IMAGING CHARGE

This application is a continuation of application Ser. No. 07/124,591, filed Nov. 24, 1987, now abandoned.

The present invention relates to improvements in an electrostatic recording medium and more particularly to an electrostatic recording medium suitable for high-density (e.g. 400 dots/inch) electrostatic facsimile devices, electrostatic printers, electrostatic plotters and so on.

The recent progress of communications technology has been imposing ever sophisticated technical demands on the art of electrostatic recording system as a means for achieving both of high speed recording and high image quality. Electrostatic facsimile devices and printers are used as output devices of optical communications and computer systems. Particularly in CAD or computer-aided design technology, high density electrostatic printers or plotters are used as output devices.

The multi-stylus recording method which has been most prevalently utilized in the field of electrostatic recording may be classified into those of the dual array writing head type and the type wherein the stylus electrode is disposed on the same side as the control electrode. With either method, a certain gap must exist between the surface of the electrostatic recording medium and the recording stylus. In the conventional recording system where the recording density is of the order of 200 dots/inch, the discharging condition is not a serious consideration, due probably to the adequate sectional area of each recording stylus. However, when the recording density is as high as about 400 dots/inch, a critical relation must be assured between the surface condition of the dielectric layer and the image quality that can be obtained. Thus, in the recording of a fine line of one dot drawing, there arises not only the problem of so-called dropout (i.e., the phenomenon that an unstable discharge results in local discontinuities of the line image) but also the flare which is an abnormal spreading of the area exposed to the discharge.

Paying attention to the resin material of the dielectric layer and electric conductivity of electroconductive suppport, we initially attempted to control the degree and distribution of surface irregularities of the dielectric layer but could not overcome the drawback of dropout arising from erratic discharge in the tracing of fine lines, and also failed to solve the problem of the flare and consequent image degradation due to the spreading of the discharged area which, depending on localities, may amount to more than 10 times the sectional area of the recording stylus.

It is an object of the present invention to provide an electrostatic recording medium which is suitable for high-density electrostatic recording of the order of 400 dots/inch and features a minimum of dropout.

It is another object of the invention to provide an electrostatic recording medium suitable for high-density electrostatic recording of the order of 400 dots/inch, which features a minimum of flare as well as a minimum of dropout.

The above and other objects, as well as various advantages, of the present invention will become apparent as the following description proceeds.

The present invention provides an electrostatic recording medium comprising an electroconductive support and a dielectric layer formed on said electroconductive support and containing an insulating resin and a pigment, said dielectric layer carrying an electrostatic charge on its surface and said charge being of a polarity opposite to that of a charge to be applied for the formation of a record image.

In view of the unsurmountable limits to improvement in the structural aspect of the electrostatic recording medium in connection with the aforementioned problems, we conducted a further investigation of the discharging and charging conditions on the surface of the dielectric layer. As a result, we found that if, prior to the application of a static charge for image formation, the surface of the dielectric layer of an electrostatic recording medium is charged to a polarity opposite to the electrostatic charge to be so applied, the incidence of the aforesaid dropout is remarkably decreased, although the aforesaid drawback of flare is not necessarily alleviated, so that at least one of the drawbacks of the prior art technology can be successfully obviated. Our research further revealed that if a static charge having a polarity opposite to that of the static charge to be applied for image formation is distributed in a pattern of islets on the surface of the dielectric layer and the maximum size of such charged islets is controlled at about 1 to 300 $\mu$, not only the aforesaid dropout but also the aforesaid flare can be reduced to minima.

The present invention has been conceived and developed on the basis of the above findings.

It has been generally believed that the surface of the dielectric layer of an electrostatic recording medium must be free of static charge prior to application of a static charge for image formation. Therefore, the present invention is quite unexpected in that it overcomes the problems of dropout and flare based on a concept quite contrary to the past thought.

As the electroconductive support for the electrostatic recording medium of the present invention, any of the materials that have been used conventionally in this field of technology can be utilized without specific restriction. Thus, one may employ a paper, plastic film, fabric or other substrate as impregnated or coated with a composition containing one of the known electrically conductive substances such as inorganic salts, e.g. sodium chloride, etc., cationic high molecular weight electrolytes, e.g. polyvinylbenzyltrimethylammonium chloride, etc., anionic high molecular weight electrolytes, e.g. polyvinyl phosphate, polystyrene sulfonate, etc., surface-active agents, semiconductive metal oxides e.g. zinc oxide, conductivity-treated zinc oxide, etc. in the conventional manner and adjusted to a surface resistivity in the range of about $10^5\ \Omega$ to $10^{11}\ \Omega$.

In the electrostatic recording medium according to the present invention, the dielectric layer comprises an insulating resin component and a pigment component. As said insulating resin component, any of the various resins used conventionally in this field of technology can be employed. Among such resins are homopolymers and copolymers of vinyl monomers such as vinyl acetate, styrene, lower alkyl (particularly $C_1$–$C_4$ alkyl) esters of acrylic or methacrylic acid; polyvinyl butyral resin; polyester resin; and so on. More specifically, vinyl acetate resin, acrylic ester resin, methacrylic ester resin, styrene-acrylate copolymer resin, polystyrene resin, polyester resin, polyvinyl butyral resin, etc. can be employed. Particularly suited for the purposes of the invention are polymethyl methacrylate resin, polybutyl methacrylate resin, methyl methacrylate-ethyl acrylate copolymer resin, styrene-acrylate copolymer resin and styrene-methacrylate copolymer resin.

As the aforesaid pigment, various inorganic or organic substances which are conventionally used in this field of technology can be employed. Specifically, inorganic pigments such as calcium carbonate, kaolin, clay, titanium oxide, talc, calcined clay, barium sulfate, calcium sulfate, amorphous silica, zinc oxide, magnesium carbonate, etc. and organic pigments such as plastic pigment powders of polyethylene resin, polyester resin, silicone resin, fluorine-containing resin, polyacrylonitrile resin, etc. may be mentioned. The particle size of such pigments is about 0.1 to 20 μ and preferably about 2 to 7 μ. These pigments may be used singly or in combination. While the amount of such pigment may vary with its kind and particle size, the type of resin component of the dielectric layer, and other factors, it is generally in the range of about 2 to 60 parts by weight and preferably in the range of about 30 to 50 parts by weight based on 100 parts by weight of the solid matter of the dielectric layer.

The dielectric layer in the present invention is formed by uniformly coating said electroconductive support with a coating composition containing said insulating resin and pigment components in an aqueous vehicle or an organic solvent and drying the same. Such coating composition is preferably prepared by first dispersing the pigment in water or organic solvent, then adding the resin to the dispersion and stirring the mixture. The amount of such coating composition to be applied is not critical but is generally about 3 to 10 $g/m^2$ and preferably about 3 to 6 $g/m^2$ on a dry basis. When the vehicle of such a coating composition is an organic solvent, any of the solvents used conventionally in this field of technology can be employed. Thus, toluene, methyl ethyl ketone, etc. may be mentioned as typical examples.

In accordance with the present invention, it is essential that the surface of the dielectric layer thus formed on the electroconductive support is electrostatically charged to a polarity opposite to that of the static charge to be applied for image formation. If the dielectric layer is charged to the same polarity as that of the charge to be used for image formation, the resulting image will be "fogged" and, moreover, it will not be possible to reduce the incidence of dropout.

The dielectric layer may be charged to the opposite polarity in continuity over the entire surface or in a network pattern, or in a pattern of islets which may be equal or varying in size. In any case, the dropout in the formation of fine lines of one dot recording can be remarkably decreased to yield a well-defined image. On the other hand, the flare which appears as dots several times as large as the sectional area of the recording stylus is not necessarily eliminated, though its degree is attenuated in certain cases, so that the image is not very sharp in many instances. As mentioned hereinbefore, this flare can be minimized by controlling the maximum size of said islets charged to the opposite polarity on the surface of the dielectric layer to the range of about 1 to 300 μ. Then, both the dropout and flare can be decreased to practical minima. From the standpoint of reducing flares, the maximum size of islets of static charge in the present invention is preferably smaller than the maximum diameter of the recording stylus and, particularly for high density recording of the order of 400 dots/inch, is in the range of about 5 to 100 μ.

When the electrostatically charged regions are distributed in a pattern of islets having a maximum size exceeding 300 μ by a usual friction treatment, the total area of such charged regions generally accounts for about 0.1 to 30%, particularly 1 to 30%, of the total area of the dielectric layer surface. When the electrostatically charged regions are distributed in a pattern of islets having a maximum size of about 1 to 300 μ, the total area of such charged regions generally accounts for about 0.001 to 10%, particularly about 0.01 to 1.0%, of the total area of the dielectric layer surface.

The islets or the like regions of static charge having a polarity opposite to that of the charge used for image formation can be observed by means of an electron microscope and when the pattern is insular, each islet appears substantially circular or elliptical. Therefore, the term 'maximum size' as used in reference to these regions in this specification and the claims appended thereto means the diameter for the circular configuration and the dimension of the major axis for the elliptical configuration. Further, the maximum size of such charged regions on the surface of the dielectric layer may either be substantially uniform throughout or be varying from one another.

The formation of electrostatically charged regions preferably having the aforementioned size on the surface of the dielectric layer may be carried out at the final stage in the fabrication of the electrostatic recording medium or, alternatively, immediately before recording by means of a built-in voltage charging device disposed independently of the charging electrode for application of static electricity for image formation.

As to the polarity of the static charge to be previously applied to the surface of the dielectric layer, whichever of positive and negative charges may be employed but since the negative polarity is more often utilized for recording with the electrostatic recording system currently available because of its high discharge efficiency as compared with the positive polarity, the positive polarity is then chosen for the static charge to be previously applied to the surface of the dielectric layer.

The reason is not necessarily clear why the prior application of a static charge having a polarity opposite to that of the recording charge to the surface of the dielectric layer is suitable for the electrostatic facsimile device and plotter for high density recording of the order of 400 dots/inch and particularly effective in the prevention of dropouts in the reproduction of fine lines of one dot recording, but it appears that compared with recording without prior application, for example, of a positive charge, recording with a negative charge on the dielectric layer carrying a positive surface charge results in a drop in the discharge starting voltage and that this drop in discharge starting voltage is responsible for the beneficial results realized in the present invention.

For the formation of a static charge having a polarity opposite to that of the recording charge on the surface of the dielectric layer, there may be employed various methods, e.g. the method of applying a static charge with a corona charger and the method using a multi-stylus electrode independent of the recording electrode, and the method of charging the surface of the dielectric layer by means of friction.

For the complete charging of the entire surface of the dielectric layer, the method using a corona charger and the like can be employed. For attaining an insular distribution of charged regions, i.e. islets, the dielectric layer completely charged over the entire surface may be subjected to a partial de-electrification treatment, such as contacting the surface with a metal roll, application of water vapor, contacting the surface with a de-electrifying brush, or the like, to thereby leave a pattern of charged islets preferably having a maximum size of about 1 to 300 μ. As an alternative procedure, such a distribution of charged islets may be formed de novo on the surface of the dielectric layer.

In the practice of the present invention, the method of imparting a static charge by means of friction is preferably employed in the sense that the method does not require the use of a complicated, expensive device. More particularly, such a distribution of charged islets preferably having a maximum size of about 1 to 300 μ can be formed by the following alternative methods: (1) the method comprising rubbing the surface of the dielectric layer with an insulating substance and an electroconductive substance, (2) the method which comprises either rubbing the surface of the dielectric layer with a substance capable of charging the surface to positive polarity and a substance capable of charging it to negative polarity each at least once or rubbing the surface of the dielectric layer with a composition of a substance capable of charging the surface to positive polarity and a substance capable of charging it to negative polarity or a substance having such two moieties within the molecule at least once, (3) the method which comprises using at least one resin capable of being positively charged upon friction with a friction material and at least one resin capable of being negatively charged upon friction with the friction material as the insulating resin component of the dielectric layer and rubbing the dielectric layer with the friction material, and (4) the method in which on the surface of the dielectric layer is formed, with use of pigment, projections having an equivalent diameter of about 5 to 15 μ and adapted to contact the recording stylus electrode to maintain a gap between the electrode and the surface of the dielectric layer in a density of at least 5 projections/mm$^2$ and other smaller projections which are prevented from contact the electrode by the presence of said gap and the surface of the dielectric layer having such projections is rubbed by a material capable of electrostatically charging the former projections or by any of the above methods (1), (2) and (3) or otherwise to impart a static charge to said larger projections. Each of these alternative methods (1) to (4) will be described in detail hereinafter.

(1) The method which comprises rubbing the surface of the dielectric layer with an insulating substance and a conductive substance.

As the insulating substance used for imparting a static charge having a polarity opposite to that of the recording charge to the surface of the dielectric layer, there can be employed various high molecular weight materials such as thermoplatic resins, e.g. polyethylene, polypropylene, polystyrene, polyvinyl butyral, polyvinyl acetate, polyester, polyvinyl chloride, polyacrylate, polyether, etc. and copolymers of the copolymerizable monomers constituting these polymers, and thermosetting resins, e.g. melamineformaldehyde resin, urea-formaldehyde resin, phenolformaldehyde resin, epoxy resin, and so on. As to the conductive substance, there can be employed high molecular weight electrolytes, anionic, nonionic, cationic or amphoteric surfactants, semiconductive metal oxide powers and so on.

The insulating substance and conductive substance used in this method may be independent materials or an integral material. For example, each of the insulating substance and the conductive substance may be molded into a bar or a roll independently, or the conductive substance may be admixed with the insulating substance and the resulting mixture may be molded into a bar or a roll. As a further alternative, a sheet or web may be impregnated with either, or both, of these materials and wrapped around a mandrel to provide a bar or a roll.

In rubbing the surface of the dielectric layer with said insulating substance and conductive substance, it is preferable that, when the two substances are independent, the insulating substance be first used and the conductive substance be next used. When the insulating substance and conductive substance are integrated into a single element, the surface of the dielectric layer may be simply rubbed with the element.

If the surface of the dielectric layer is rubbed with the insulating substance alone to form a static charge, the resulting charged regions will vary greatly in size, with many regions having maximum size exceeding 300 μ. Preferably, the surface carrying such extralarge charged regions exceeding 300 μ in maximum size is rubbed with a conductive substance to adjust the maximum size of the regions to the range of about 1 to 300 μ. On the other hand, when an integral element comprising both the conductive and insulating substances, the formation of the required static charge and the necessary adjustment of charged regions to the range of about 1 to 300 μ can be simultaneously accomplished.

The procedure for formation of a static charge having a polarity opposite to that of the recording charge is described below in further detail.

When the recording static charge to be applied by a multi-stylus electrode is of negative polarity, the dielectric layer is first rubbed with a material capable of charging its surface to positive polarity.

Electron microscopy shows that the static charge thus obtained is distributed either in a pattern of islets of irregular sizes or in a mesh-like pattern. When a fine line image of one dot recording is formed with a recording medium having such a distribution of charge using an electrostatic recording device, the resulting image is superior in respect of dropout but still has the drawback of flare. However, as the surface of the dielectric layer is rubbed with a conductive substance, the maximum size of positively charged regions is rendered substantially uniform within the range of about 1 to 300 μ, with the result that not only the dropout at one-dot recording is reduced but the incidence of the flare which would occur frequently at one-dot recording in particular is drastically reduced. The improvement effect obtained by this rubbing method is still observed even one full year after the treatment.

(2) The method which comprises rubbing the surface of the dielectric layer with a substance capable of charging the surface to positive polarity and a substance capable of charging it to negative polarity each at least once or rubbing the surface of the dielectric layer with either a mixture of a substance capable of charging the surface to positive polarity and a substance capable of charging it to negative polarity or a substance having both of such moieties within the molecule at least once.

The substances used for rubbing the surface of the dielectric layer for the formation of a static charge opposite in polarity to the recording charge are suitably selected according to the composition of the dielectric layer.

By way of illustration, as the substances capable of imparting a positive charge to a dielectric layer made from a 1:1:1 mixture of polymethyl methacrylate, polybutyl methacrylate and calcium carbonate upon rubbing treatment, there may be mentioned polymethyl methacrylate, polybutyl methacrylate, polystyrene, methyl methacrylate-ethyl acrylate copolymer, polyvinyl butyral resin, polyester, aluminum, ceramics and so on. As examples of the substance capable of imparting a negative charge to such a dielectric layer, there may be mentioned styrene-methyl methacrylate copolymer, styrene-butyl methacrylate copolymer and so on. As examples of the substance capable of imparting a positive charge to a dielectric layer comprising a mixture of polymethyl methacrylate and calcium carbonate upon rubbing treatment, there may be mentioned vinyl butyral resin, styrene-methyl methacrylate copolymer and so on. As examples of charging such a dielectric layer to negative polarity, there may be mentioned polybutyl methacrylate, polyester, polystyrene and so on. To impart a positive charge to a dielectric layer comprising a mixture of polymethyl methacrylate and clay upon rubbing treatment, one may employ polyvinyl butyral resin, styrene-methyl methacrylate copolymer or the like. For imparting a negative charge to the same dielectric layer, one may employ polybutyl methacrylate, polystyrene or the like. The desired static charge may be formed with improved efficiency by adding an inorganic pigment such as calcium carbonate, clay, silica, etc., a plastic pigment and/or a surfactant to the aforesaid substance for rubbing treatment.

The method which comprises rubbing the surface of the dielectric layer with a substance capable of charging the surface to positive polarity and a substance capable of charging it to negative polarity each at least once to form a static charge having a polarity opposite to the static charge to be applied for image formation with an electrostatic recording device is first described in detail below.

When the recording static charge to be applied with an electrostatic recording device is a negative charge, generally the dielectric layer is first rubbed with a substance capable of charging it to positive polarity. Electron microscopy shows that the static charge formed by this procedure is distributed either in a pattern of islets of irregular sizes or in a meshlike pattern. When a fine line of one dot recording is formed with such a distribution of charge using an electrostatic recording device, the resulting image is superior in respect of dropouts but still has the drawback of flare. However, as the surface of the dielectric layer is further rubbed with a substance capable of charging the surface to negative polarity, the size of positively charged regions is rendered substantially uniform within the range of about 1 to 300 $\mu$, with the result that not only the dropout at one-dot recording is reduced but the incidence of the flare which would otherwise occur frequently at one-dot recording in particular can be reduced to a minimum. Moreover, the improvement effect obtained by this friction method is still observed even after one full year.

As an alternative, the above treatment can be effected by the method which comprises rubbing the dielectric layer with a composition comprising a substance capable of imparting a positive charge and a substance capable of imparting a negative charge at least once. The term 'composition' as used herein covers not only a mixture of such two substances, preferably a homogeneous mixture, but also a substance which contains both a negative charge moiety and a positive charge moiety within its molecule.

(3) The method in which one uses at least one resin adapted to be positively charged with a friction material and at least one resin adapted to be negatively charged with the friction material as the insulating resin component of the dielectric layer and rubbing the dielectric layer with the friction material.

The friction material which can be used to rub the surface of the dielectric layer in this method includes, among others, polyethylene resin, polypropylene resin, polystyrene resin, polyether resin, polyvinyl chloride resin, polymethyl methacrylate resin, amino resin such as melamine-formaldehyde resin and urea-formaldehyde resin, phenol-formaldehyde resin, epoxy resin, polyimide and so on. Of the above-mentioned resins, those preferred from the standpoints of the ease of fabrication of a friction element, wear resistance, the ease of generation of static electricity by friction, and the ease of controlling the size of charged regions on the dielectric layer are thermoplastic resins such as polystyrene resin, styrene-lower(e.g. $C_1$–$C_4$)alkyl acrylate copolymer, styrene-lower(e.g. $C_1$–$C_4$)alkyl methacrylate copolymer, polymethyl methacrylate resin, etc. and thermosetting resins such as epoxy resin, melamine-formaldehyde resin, urea-melamine resin, benzoguanamine resin and so on. These friction material can be used singly or in mixture.

Referring to the insulating resin component forming the dielectric layer of the electrostatic recording medium, the resin adapted to be positively charged and the resin adapted to be negatively charged on frictional treatment are such that their polarity of charge is dependent on the type of friction material and the type of pigment as a constituent of the dielectric layer, although the polarity of the insulating resin is not changed according to the proportions of the resin and pigment.

By way of illustraiton, when the friction material is polymethyl methacrylate and the pigment is calcium carbonate, the aforesaid insulating resin adapted to be positively charged may for example be methyl methacrylateethyl acrylate copolymer and the aforesaid insulating resin adapted to be negatively charged may for example be polymethyl methacrylate, polybutyl methacrylate, styrene-methyl methacrylate copolymer, polyester, polystyrene, polyvinyl butyral or the like.

When the friction material is polymethyl methacrylate and the pigment is calcined clay, the insulating resin adapted to be positively charged may for example be polymethyl methacrylate, methyl methacrylate-ethyl acrylate copolymer, polybutyl methacrylate or the like, while the insulating resin adapted to be negatively charged may for example be styrene-methyl methacrylate copolymer, polyester, polystyrene, polyvinyl butyral or the like.

When the friction material is polystyrene resin and the pigment is calcium carbonate, the insulating resin adapted to be positively charged may for example be methyl methacrylate-ethyl acrylate copolymer, styrene-methyl methacrylate copolymer, polyester, polystyrene or the like, while the insulating resin adapted to be negatively charged may for example be polyvinyl butyral.

When the friction material is polystyrene resin and the pigment is calcined clay, the insulating resin adapted to be positively charged includes, among others, methyl methacrylate-ethyl acrylate copolymer, polybutyl methacrylate, styrene-methyl methacrylate copolymer, polyester, etc., while the insulating resin adapted to be negatively charged includes polystyrene, polyvinyl butyral and so on.

Further, when the friction material is polystyrene resin and the pigment is amorphous silica, the insulating resin adapted to be positively charged includes, among others, polymethyl methacrylate, methyl methacrylateethyl acrylate copolymer, styrene-methyl methacrylate copolymer and polyester, while the insulating resin adapted to be negatively charged includes polybutyl methacrylate, polystyrene, polyvinyl butyral and so on.

In this method, either a positive charge or a negative charge can be formed in a pattern of islets of substantially uniform size on the surface of the dielectric layer by selecting the proper friction material and pigment and controlling the proportions of the resin adapted to be positively charged and the resin adapted to be negatively charged in the dielectric layer.

Therefore, in this method, the compounding proportions of the two types of resin are adjusted so that a static charge having a polarity opposite to that of the recording static charge may be formed by friction. When the recording static charge is of negative polarity, the resins are formulated so that a positive charge will be formed on the dielectric layer.

When polymethyl methacrylate, for instance, is used as the friction material, there may be employed calcium carbonate as the pigment to be incorporated in the dielectric layer and a mixture of methyl methacrylateethyl acrylate copolymer with polybutyl methacrylate as the insulating resin component. When the friction material is polystyrene, one may employ amorphous silica as the pigment to be incorporated in the dielectric layer and a mixture of polymethyl methacrylate with polybutyl methacrylate as the insulating resin component. These are prefered combinations and one may also use other combinations.

The static charge having a polarity opposite to that of the recording static charge as pre-formed by this method on the surface of the dielectric layer has a pattern of islets which are substantially uniform in size within the range of about 1 to 300 $\mu$. With such a recording medium, one-dot recording by the electrostatic recording device yields a sharp image free of dropouts and flare.

(4) The method in which a pigment is used to form projections within a specified equivalent diameter range and other projections which are relatively smaller in equivalent diameter and an electrostatic charge is applied to the projections within a specified equivalent diameter range.

The term 'equivalent diameter' as used in connection with this method is the value (d) dependent on the projected area (s) of each projection as observed when the surface of the dielectric layer is observed with a scanning electron microscope and can be calculated by means of the following equation.

$$d=2\times(s/\pi)^{\frac{1}{2}}$$

In this method, projections having an equivalent diameter of about 5 to 15 $\mu$ are formed on the surface of the dielectric layer for the formation of a gap or space between the surface of the dielectric layer and the stylus electrode and these projections are electrostatically charged to a polarity opposite to the static charge to be used for image formation to produce charged islets of uniform size.

The projections thus formed on the surface of the dielectric layer are generally formed of a pigment. Thus, said projections in the equivalent diameter range of about 5 to 15 $\mu$ are produced by using two or more kinds of said inorganic or organic pigment in the particle size range of about 0.1 to 20 $\mu$ and controlling the proportions and combination thereof, depending on the polarity of static charge to be imparted, the combination of the pigment and the resin, and other factors. It is important to employ two or more kinds, preferably two kinds, of pigments differing in particle size.

When one kind of pigment is used, namely when a pigment having a single particle size distribution is used, the projections thus formed are distributed continuously in terms of their height, and groups of projections resembling a mountain range are formed depending on localities. As a result, when the dielectric layer is rubbed with a friction material consisting of a single substance, such projections are strongly rubbed by the friction material and tend to be electrostatically charged, and the resulting charged regions will have a maximum size greater than 300 $\mu$ with the result that the effect of reducing flare cannot be improved.

Thus in this method, it is necessary to use a pigment of larger particle size for forming the projections having an equivalent diameter of about 5 to 15 $\mu$ in combination with a pigment of smaller particle size for forming projections of smaller equivalent diameter. In this method, the larger projections having an equivalent diameter of about 5 to 15 $\mu$ form the gap between the surface of the dielectric layer and the stylus electrode. The foregoing projections of smaller equivalent diameter are distributed out of contact with the recording electrode and have a function of attenuating the gloss of the surface of the dielectric layer to thereby give "natural effect" (effect of giving an appearance resembling a usual paper to the electrostatic recording medium) and also of increasing the recording density.

Thus, in connection with the projections formed in this method on the surface of the dielectric layer by using two kinds of pigments each having a single particle size distribution, there are two peak values in the distribution of equivalent diameter, one existing in the range of 5 to 15 $\mu$ corresponding to the projections of larger equivalent diameter and the other existing in the range of 0.3 to 3 $\mu$, preferably 0.3 to 1 $\mu$, corresponding to the projections of smaller equivalent diameter. The projections of larger equivalent diameter should preferably be distributed with a density of at least 5 projections/mm$^2$.

In this method, the particle size, amount and the like of the pigments used are suitably selected so as to form the projections in the above distribution. Each projections are formed with a single particle of pigment or with an aggregated mass of a plurality of particles of pigment as the nucleus. In order to form the projections of larger equivalent diameter, it is necessary to use the aforesaid inorganic or organic pigment having an average particle size of not less than 3 $\mu$ but not greater than 10 $\mu$ and having a single particle size distribution in an amount of about 2 to 30 parts by weight per 100 parts by weight of the total solids of the dielectric layer. When the pigment of larger particle size within the above-mentioned 3 to 10 $\mu$ range is used, the desired projections can be formed by using such pigment in a smaller amount within the above range. On the other hand, when the pigment of smaller particle size is used, it should be used in a larger amount within the above range. Furthermore, in order to form the projections of smaller equivalent diameter, it is also necessary to additionally use an inorganic or organic pigment having an average particle size of not less than 0.1 μ but less than 3 μ and having a single particle size distribution in an amount of about 2 to 30 parts by weight per 100 parts by weight of the total solids of the dielectric layer. As such pigment, the aforesaid inorganic or organic pigments can be used, and among others amorphous silica, precipitated calcium carbonate, calcined clay and the like are preferred. When such pigment used has a smaller particle size within said range, the desired projections of smaller equivalent diameter can be formed by using such pigment in a smaller amount within the above range, thereby effectively attenuating the gloss of the dielectric layer. On the other hand, when the pigment having a particle size close to 3 μ is used, such pigment should be used in a larger amount within the above range so as to achieve the comparable effect of attenuating the gloss.

In this method, the coating composition containing such two kinds of pigments and an insulating resin for forming the dielectric layer is formulated and applied to the electroconductive support in a manner as mentioned hereinbefore.

In accordance with the present invention, the dielectric layer comprising said pigment and resin components is effective in the prevention of dropout without the need for specific adjustment of surface roughness only if it carries a surface static charge having a polarity opposite to that of the voltage to be applied for image formation but, in this method, both the dropout and flare can be prevented more effectively and additionally a solid black image can be formed with excellent uniformity by controlling the surface roughness of the dielectric layer (i.e., distribution of the projections) as described above.

In this method, the projections having an equivalent diameter of 5 to 15 μ formed with the pigment of larger particle size are electrostatically charged upon friction with a friction material which can consist of a single substance. Generally the other projections of smaller equivalent diameter are not directly rubbed by a friction material and are not electrostatically charged. As a result, charged regions are distributed in a pattern of islets of uniform size. Therefore, excellent record images are obtained substantially free of dropout and flare.

When all the projections formed on the surface of the dielectric layer are in the equivalent diameter range below 5 μ, a friction material will come into contact with the surface of the dielectric layer with a larger contact area, often forming charged regions having a maximum size of greater than 300 μ, and thereby causing flare to some extent, and there sometimes occur the areas at which recording electrode comes into direct contact with the dielectric layer surface and in these areas there takes place a direct conduction of electricity so that no recording discharge occurs. Therefore, whereas almost substantially continuous formation of a fine line of one-dot recording can be obtained, it tends to happen that in the formation of a solid black image the particular non-discharging areas are left blank as dots to somewhat affect the uniformity of the image quality. On the other hand, when projections having equivalent diameters in excess of 15 μ are present, the contact of such projections with the recording electrode results in an excessive gap between the electrode and the surface of the dielectric layer so that the required discharge does not take place. Therefore, whereas almost substantially continuous formation of a fine line of one-dot recording can be obtained, the uniformity of a solid black image tends to be adversely affected to some extent.

Moreover, said projections in the equivalent diameter range of about 5 to 15 μ are preferably distributed on the dielectric layer surface with a density of at least 5 projections per $mm^2$. If the density is less than 5 projections/$mm^2$, the function of creating an appropriate gap between said recording electrode and said dielectric layer surface may not work well locally due to irregularity and undulation of the recording medium so that whereas a substantially continuous formation of a fine line of one-dot recording can be obtained, the uniformity of a solid black image tends to be somewhat affected On the other hand, the formation of projections with a density of more than 200 projections per $mm^2$ does not contribute to any further improved effects and, therefore, is not necessary. Moreover, if the number of projections is too large, the projections may become virtually continuous, making it difficult to locally charge the projections, with the result that the maximum size of charged regions having a polarity opposite to the charge to be applied for image formation may undesirably exceed 300 μ.

For the application of a static charge having a polarity opposite to that of the recording charge to the aforesaid projections (mainly those having equivalent diameters in the range of 5 to 15 μ) distributed on the surface of the dielectric layer, there may be employed the method which comprises applying a static charge using a multi-stylus electrode independent of the recording electrode and the technique which comprises rubbing the surface of the dielectric layer, among others. As a specific procedure for the application of such a static charge by rubbing, any method in which the dielectric layer is rubbed by a friction material capable of charging the larger projections, but preferably any of the methods (1) to (3) described hereinbefore can be employed, although the first-mentioned method (1) is most preferred.

The condition of static charge obtainable by each of the friction methods (1) to (4) can be controlled by selecting the proper composition of said friction material, rubbing pressure, number of rubbings, speed of rubbing, and so on. Such treatment is generally performed with the friction material in the form of a roll or plate or in the form of an element fabricated by impregnating a substrate sheet with the friction material and wrapping it around a support or a mandrel, and may be carried out in the step following the formation of the dielectric layer or in the finishing step, or subsequently by the treating device built into the electrostatic recording device. For this treatment, the friction material is applied against the dielectric layer of the traveling electrostatic recording medium. When the friction material is provided in the form of a roll, the rubbing treatment can be carried out with a revolving roll, in which case the formation of mars on the surface of the dielectric layer can be prevented. The formation of such surface mars can also be prevented by allowing a friction material in the form of a continuous sheet to slide over a support in the form of a roll and applying the friction material against the dielectric layer surface of the traveling electrostatic recording medium.

The above description pertains mainly to the electrostatic recording system in which the charge to be applied for image formation is of negative polarity but the same effects can be realized in the case where the recording charge is of positive polarity by previous formation of a negative static charge on the surface of the dielectric layer of the electrostatic recording medium.

Further, according to the research by the present inventors, it was found that the preventive effect on dropout and flare can be further enhanced by incorporating an oleaginous substance having a volume resistivity of not less than $10^8$ Ω·cm (exclusive of substances boiling at temperatures less than 250° C.) in the dielectric layer.

Therefore, the present invention further provides an electrostatic recording medium having a dielectric layer which carries on its surface a static charge having a polarity opposite to that of the static charge to be applied for image formation and which contains an oleaginous substance having a volume resistivity of not less than $10^8$ Ω·cm (exclusive of substances boiling at temperatures less than 250° C.) in addition to the insulating resin and pigment.

The oleaginous substance to be thus incorporated in the dielectric layer of the electrostatic recording medium can be selected from a range of substances which are liquid at room temperature and, for the prevention of decreases in image density, has a volume resistivity not less than about $10^8$ Ω·cm and preferably in the range of about $10^8$ to $10^{14}$ Ω·cm, with boiling points at atmospheric pressure in the range not less than 250° C. and preferably not less than about 300° C. Among such oleaginous substances are phthalic esters such as dimethyl phthalate, diethyl phthalate, dibutyl phthalate, diisobutyl phthalate, dihexyl phthalate, di- 2-ethylhexyl phthalate, diisodecyl phthalate, diisotridecyl phthalate, butyl benzyl phthalate, butyl lauryl phthalate, methyl oleyl phthalate, etc.; aliphatic dibasic acid esters such as succinic esters, e.g. dioctyl succinate, diisodecyl succinate, etc.; adipic esters, e.g. dibutyl adipate, dihexyl adipate, diheptyl adipate, dioctyl adipate, di-2-ethylhexyl adipate, diisodecyl adipate, dicapryl adipate, di-3,5,5-trimethylhexyl adipate, etc.; azelaic esters, e.g. dioctyl azelate, di-2-ethylhexyl azelate, diisodecyl azelate, etc.; and sebacic esters, e.g. dibutyl sebacate, di-2-ethylhexyl sebacate, dioctyl sebacate, diisodecyl sebacate, etc.; fatty acid esters, e.g. butyl oleate, methyl acetylricinoleate, etc.; epoxy compounds and particularly epoxystearic esters, e.g. butyl epoxystearate, octyl epoxystearate, benzyl epoxystearate, etc.; phosphoric esters, e.g. tributyl phosphate, trioctyl phosphate, tricresyl phosphate, diphenylcresyl phosphate, etc.; polyesters, e.g. polypropylene sebacate, polypropylene adipate, etc.; alkyl-substituted biphenyls and particularly lower (e.g., $C_1$–$C_4$) alkyl-substituted biphenyls, e.g. dimethyl-biphenyl, trimethylbiphenyl, propylbiphenyl, isopropylbiphenyl, etc.; alkyl- or alkenyl-substituted naphthalenes and particularly lower (e.g., $C_1$–$C_4$) alkyl- or alkenyl-substituted naphthalenes such as dimethylnaphthalene, propylnaphthalene, propenylnaphthalene, allylnaphthalene, butylnaphthalene, dipropylnaphthalene, diisopropylnaphthalene, etc.; alkyl-substituted tetralins and particularly lower (e.g., $C_1$–$C_4$) alkyl-substituted tetralins, e.g. methyltetralin, ethyltetralin, propyltetralin, butyltetralin, etc.; toluene derivatives and particularly benzyltoluenes such as monobenzyltoluene, dibenzyltoluene, etc.; saturated hydrocarbons such as n-hexadecane, etc.; and ethers, e.g. dibenzyl ether and so on.

Among the aforementioned oleaginous substances, phthalic esters, aliphatic dibasic acid esters, fatty acid esters, epoxy compounds, phosphoric esters, and polyesters are particularly desirable in terms of the prevention of dropout and flare.

The oleaginous substance is preferably one that is well compatible with the resin or resins used as a component of the dielectric layer and substantially free of odor and toxicity.

Moreover, since substances boiling at temperatures less than 250° C. at 760 mmHg tend to be emanated off on drying after coating of the dielectric layer, it is preferable to use an oleagenous substance having a boiling point over 250° C. and preferably over about 300° C. When the level of addition of said oleagenous substance is too low, the improving effect on dropout and flare is not sufficient, while an excess of the oleagenous substance may adversely affect the image characteristics. Therefore, the oleaginous substance is used in a proportion of about 0.1 to 20 parts by weight, preferably about 1 to 10 parts by weight, and more desirably about 2 to 6 parts by weight, per 100 parts by weight of the solids in the dielectric layer.

The reason is not fully clear why the above effect is obtained by the addition of an oleaginous substance. It is, however, presumed that the incorporation of said oleaginous substance in the dielectric layer leads to a drop in discharge starting voltage.

The oleaginous substance can be added to the coating composition in any of various stages of preparation of the dielectric coating composition, e.g. at dispersion of the pigment, at dissolution of the resin, or after dissolution of the resin.

The research by the present inventors revealed that the electrostatic recording medium comprising a dielectric layer containing the aforementioned oleaginous substance is effective in the prevention of dropout and flare even when the surface of the dielectric layer is not electrostatically charged, although better results are obtained when such a dielectric layer containing the oleaginous substance carries a surface static charge of a polarity opposite to that of a charge to be applied for image formation.

Therefore, the present invention further provides an electrostatic recording medium comprising an electroconductive support and, as disposed thereon, a dielectric layer comprising an insulating resin and a pigment, and further containing an oleaginous substance having a volume resistivity of not less than $10^8$ Ω·cm and having a boiling point of not less than 250° C.

The following examples and reference examples are further illustrative of the present invention. In these examples, all parts and % are by weight unless otherwise indicated. It should also be understood that the dropout and flare of the electrostatic recording medium obtained in each of the examples and reference examples were evaluated by recording a 1-dot, 1-meter long fine line with Matsushita Graphic Communication System Inc.'s electrostatic plotter EP-101Al, which feature a recording density of 400 dots/inch, using a negative recording charge and, after development, determining the total length (mm) of dropout regions and the number of abnormal dots due to flare. The electrostatically charged regions are observed by electron microscopy with Japan Electronics Model JSM-T-300 at an accelerating voltage of 2 kV for the observation of the secondary electron image (the positive static charge appears black and the negative static charge appears white).

EXAMPLE I

Fabrication of the recording medium:

To a wood-free paper weighing 53 g/m$^2$ was applied a cationic high molecular weight electrolyte (trade name: Chemistat 6300, manufactured by Sanyo Chemical Industries) in an amount of 3 g/m$^2$ on a dry basis on the face side and in an amount of 2 g/m$^2$ on a dry basis on the reverse side to provide a conductive support. To the face side surface of this conductive support was applied a coating composition prepared by mixing a calcium carbonate powder having an average particle size of 5 $\mu$ and methyl methacrylate resin in a ratio of 1:1 in toluene in an amount of 5 g/m$^2$ on a dry basis to provide a dielectric layer. This product was designated as Electrostatic Recording Medium I.

EXAMPLE I-1

On the surface of the dielectric layer of the above Electrostatic Recording Medium I, a static charge of positive polarity was formed at a recording speed of 50 mm/sec by applying +300 V to the pin electrode and −300 V to the sub-electrode with a pulse width of 50 $\mu$ sec and a pulse interval of 20 m sec using an electrostatic recording simulator equipped with Matsushita Graphic Communication System Inc.'s UF-520-IV (16 pins/mm) recording head.

The surface potential of this dielectric layer as measured with a surface potentiometer was +40 V. Electron microscopy revealed an insular distribution of circular dots of static charge having a uniform diameter of 50 $\mu$ on the surface of the dielectric layer.

Using the electrostatic recording medium thus treated for the formation of a static charge, one-dot fine line recording was carried out with Matsushita Graphic Communication System Inc.'s electrostatic plotter EP-101 Al by applying a negative charge voltage, followed by development. As shown in Table 1, the resulting record was quite satisfactory with minima of flare and dropout.

EXAMPLE I-2

A plus corona was generated using a DC corona generator at a corona voltage of 9 KV and the above Electrostatic Recording Medium I was exposed to the corona discharge to form a static charge of positive polarity over the entire surface of its dielectric layer.

The surface potential of the dielectric layer as measured with a surface potentiometer was +30 V. Electron microscopy revealed that a positive charge had been uniformly formed over the entire surface of the dielectric layer.

Using the Electrostatic Recording Medium I thus treated for the formation of a static charge, recording and development were carried out in the same manner as Example I-1. The resulting record was quite satisfactory with minima of flare.

REFERENCE EXAMPLE I-1

Using Matsushita Graphic Communication System Inc.'s electrostatic plotter EP-101 Al, one-dot record of a fine line was made on the dielectric layer of Electrostatic Recording Medium I without the prior treatment for the formation of a static charge according to Examples I-1 and I-2. The record showed a number of dropouts. The data are given in Table 1.

REFERENCE EXAMPLE I-2

Using a DC corona generator, a minus corona was generated at a corona voltage of 9 KV and Electrostatic Recording Medium I was exposed to this corona to form a static charge of negative polarity on the entire surface of its dielectric layer.

The surface potential of the dielectric layer as measured with a surface potentiometer was −40 V. Electron microscopy revealed that a negative static charge had been formed over the entire surface of the dielectric layer.

Using Electrostatic Recording Medium I thus treated for the formation of a static charge, recording and development were carried out in the same manner as Example I-1. The resulting surface of the dielectric layer was slightly fogged over the entire surface. The resulting record had many dropouts.

The dropout and flare data are shown in Table 1.

TABLE 1

| | | Dropout (mm/m) | Flare (abnormal dots/m) |
|---|---|---|---|
| Example | I-1 | 6 | 30 |
| Example | I-2 | 20 | 53 |
| Reference Example | I-1 | 55 | 49 |
| Reference Example | I-2 | 59 | 51 |

EXAMPLE II

To a conductive support prepared in the same manner as Example I was applied a dielectric coating composition prepared by admixing a copolymer of methyl methacrylate and ethyl acrylate (1:1) with calcium carbonate in a ratio of 1:1 by weight in toluene in an amount of 5 g/m$^2$ on a dry basis. This product was designated as Electrostatic Recording Medium II.

EXAMPLE II-1

To a wood-free paper was applied a resin composition comprising a mixture of 200 parts by weight of methyl ethyl ketone, 80 parts by weight of polystyrene and 20 parts by weight of a cationic surfactant (trade name; Cation BB, manufactured by Nippon Oil and Fats) in an amount of 10 g/m$^2$ on a dry basis and, after drying, the coated paper was wrapped around a polystyrene bar having a diameter of 150 mm with the coated side exposed. Using this element, the surface of the dielectric layer of the above Electrostatic Recording Medium II was rubbed under ambient temperature and humidity conditions at a pressure of 260 g/cm$^2$ and a speed of 10 m/min to provide an electrostatic recording medium of the present invention.

After the above friction treatment, the surface potential of the dielectric layer was +2 V. Electron microscopy revealed an insular distribution of positive charge, with most of the islets being 1 to 300 $\mu$ and few islets exceeding 300 $\mu$ in maximum size. Using this friction-treated electrostatic recording medium, one-dot recording was carried out with Matsushita Graphic Communication System Inc's electrostatic plotter EP-101 Al by applying a negative voltage to its pin electrode. As shown in Table 2, the resulting record was quite satisfactory with minima of dropout and flare.

EXAMPLE II-2

In 200 parts by weight of methyl ethyl keotne was dissolved 20 parts by weight of polystyrene followed by addition of 10 parts by weight of conductive zinc oxide powder to prepare a coating composition. To a wood-free papaer was applied the above coating composition in an amount of 10 g/m$^2$ on a dry weight basis and, after drying, the coated paper was supercalendered to smooth out the coated surface. The coated paper was then wrapped around a polystyrene bar having a diameter of 150 mm, with the coated side exposed. Using this element, the dielectric layer surface of said Electrostatic Recording Medium II was rubbed under ambient temperature and humidity conditions at a pressure of 260 g/cm$^2$ and a speed of 10 m/min to give an electrostatic recording medium of the present invention.

After the above friction treatment, the surface potential of the dielectric layer was +1.5 V. The static charge was of positive polarity and showed an insular distribution, with most of the islets being 1 to 300 $\mu$ and few islets exceeding 300 $\mu$ in maximum size as observed by electron microscopy under the same conditions as in Example II-1. Using this friction-treated electrostatic recording medium, one-dot recording was carried out with Matsushita Graphic Communication System Inc's electrostatic plotter EP-101 Al by applying a negative voltage to the pin electrode. As shown in Table 2, the resulting record was satisfactory with minima of dropout and flare.

EXAMPLE II-3

Using a polystyrene bar having a diameter of 150 mm, the dielectric layer surface of said Electrostatic Recording Medium II was rubbed under ambient temperature and humidity conditions at a pressure of 260 g/cm$^2$ and a speed of 10 m/min. To a wood-free paper was applied an amphoteric surfactant (trade name: Amphitol 24B, manufactured by Kao Soap) in an amount of 5 g/m$^2$ on a dry basis and wrapped around a polystyrene roll having a diameter of 150 mm, with the coated side exposed. Using this element, the surface of the above dielectric layer was rubbed at a pressure of 100 g/cm$^2$ and a speed of 10 m/min. to provide an electrostatic recording medium of the present invention.

After the above friction treatment, the surface potential of the dielectric layer was +2 V. Electron microscopy under the same conditions as in Example II-1 revealed that the static charge on the dielectric layer was insular in distribution, with most of the islets being 1 to 300 $\mu$ and few islets exceeding 300 $\mu$ in maximum size. Using this recording medium, one-dot recording was carried out with Matsushita Graphic Communication Systems' electrostatic plotter EP-101 Al by applying a negative voltage to its pin electrode. The resulting record was quite satisfactory with minima of dropout and flare, as shown in Table 2.

REFERENCE EXAMPLE II-1

Using Electrostatic Recording Medium II as such, one-dot recording was carried out with Matsushita Graphic Communication System Inc's electrostatic plotter EP-101 Al. As shown in Table 2, this medium was considerably inferior to the electrostatic recording medium of the invention, showing many dropouts.

EXAMPLE II-4

Using a polystyrene roll having a diameter of 150 mm, the dielectric layer surface of Electrostatic Recording Medium II was rubbed under ambient temperature and humidity conditions at a pressure of 260 g/cm$^2$ and a speed of 10 m/min.

After the friction treatment, the surface potential of the dielectric paper was +2 V. Electron microscopy revealed an insular distribution of positive static charge, with many islets exceeding 300 $\mu$ in maximum size (200 islets in a 5×5 cm frame). Using this friction-treated electrostatic recording medium, one-dot recording was carried out using Matsushita Graphic Communication System Inc's electrostatic plotter EP-101 Al by applying a negative electrode to its pin electrode. As shown in Table 2, the resulting record was by far superior to the record obtained in Reference Example II-1 in terms of dropout.

REFERENCE EXAMPLE II-2

A styrene-methyl methacrylate (3:1) copolymer and an amphoteric surfactant (trade name:Amphitol 24B, Kao Soap) were admixed in a ratio of 80:20 on a dry basis and applied to a wood-free paper in an amount of 10 g/m$^2$ on a dry basis. This coated paper was wrapped around a polystyrene roll having a diameter of 150 mm with the coated side exposed and the dielectric layer surface of the above recording medium was rubbed at a pressure of 260 g/cm$^2$ and a speed of 10 m/min.

After the above friction treatment, the surface potential of the dielectric layer was −1 V. This negative charge showed an insular distribution and electron microscopy revealed that most of the islets are 1 to 300 $\mu$ in maximum size.

Using this friction-treated electrostatic recording medium, one-dot recording was carried out with Matsushita Graphic Communication Systems' electrostatic plotter EP-101 Al by applying a negative voltage to its pin electrodes. As shown in Table 2, the resulting record showed many dropouts, being by far inferior to the electrostatic recording medium of the invention.

REFERENCE EXAMPLE II-3

A reference electrostatic recording medium was prepared in the same manner as in Example II-1 except that the dielectric layer, after charged by the friction treatment to a surface potential of +2 V, was de-electrified by being rubbed with a de-electrification brush of stainless steel wire. Electron microscopy showed no charge on the surface of the dielectric layer. Using this recording medium, one-dot recording was conducted in the same manner as in Example II-1. The results are shown in Table 2 below.

TABLE 2

| | | Dropout (mm/m) | Flare (abnormal dots/m) |
|---|---|---|---|
| Example | II-1 | 6 | 34 |
| Example | II-2 | 7 | 36 |
| Example | II-3 | 6 | 35 |
| Reference Example | II-1 | 51 | 48 |
| Example | II-4 | 8 | 91 |
| Reference Example | II-2 | 48 | 50 |
| Reference Example | II-3 | 53 | 49 |

It is apparent from Table 2 that both the dropout and flare are attenuated when the surface of the dielectric layer has been rubbed with an insulating substance and a conductive substance to provide a distribution of charged islets with a maximum size of about 1 to 300 $\mu$ in the polarity opposite to that of the charge applied for image formation. It is also apparent that even if the maximum size of said charged islets is more than 300 $\mu$, at least the dropout is minimized (Example II-4).

EXAMPLE III

Fabrication of the electrostatic recording medium (1) Recording medium III-A

To an electroconductive support prepared in the same manner as Example I was applied a composition prepared by mixing calcium carbonate powder having an average particle size of 5 μ, polymethyl methacrylate and polybutyl methacrylate in a ratio of 2:2:6 by weight in toluene in an amount of 5 g/m$^2$ on a dry basis to form a dielectric layer. This product was designated as Electrostatic Recording Medium III-A.

(2) Recording Medium III-B

To an electroconductive support prepared in the same manner as Example I was applied a 1:1 (by weight) composition of 5 μ calcium carbonate and polymethyl methacrylate in toluene in an amount of 5 g/m$^2$ on a dry basis to form a dielectric layer. This product was designated as Electrostatic Recording Medium III-B.

Friction treatment

On a glass plate was placed the electrostatic recording medium with its dielectric layer up and the surface of the dielectric layer was rubbed with a friction roll under its own weight (pressure 260 g/cm$^2$, contact width about 3 mm) at a speed of 10 m/min.

Recording

One-dot fine-line recording was carried out using Matsushita Graphic Communication System Inc's electrostatic plotter EP-101 Al (the latent image was produced by applying a negative charge by the recording electrode).

EXAMPLE III-1

A styrene-methyl methacrylate (3:1) copolymer was mixed with polymethyl methacrylate in a ratio of 3:1 in toluene and was applied to a wood-free paper in an amount of 10 g/m$^2$ on a dry basis. This coated paper was wrapped around a polystyrene roll having a diameter of 100 mm (2 kg) with the coated side exposed to provide a friction element and Electrostatic Recording Medium III-A was rubbed with the above friction element. The surface static charge thus produced had an insular distribution, with individual islets ranging from 1 to 300 μ in maximum size. As shown in Table 3, the record was satisfactory with minima of dropout and flare.

EXAMPLE III-2

Electrostatic Recording Medium III-A was rubbed with a polystyrene roll having a diameter of 100 mm (2 kg). Separately, to a wood-free paper was applied a toluene solution of styrene-methyl methacrylate (3:1) copolymer in an amount of 10 g/m$^2$ on a dry basis and the coated paper was wrapped around a polystyrene roll having a diameter of 100 mm with the coated side exposed. The above recording medium was further rubbed with this friction element. The dielectric layer of this medium showed an insular distribution of positive static charge, with individual charged islets ranging from 1 to 300 μ in maximum size. As shown in Table 3, the record obtained with this medium was satisfactory with minima of dropout and flare.

EXAMPLE III-3

A wood-free paper coated with a 1:1 mixture of polyvinyl butyral and polystyrene in a mixture of toluene and methyl ethyl ketone (1:1) was wrapped around a polystyrene roll having a diameter of 100 mm with the coated side exposed to provide a friction element. Then, Electrostatic Recording Medium III-B was rubbed with the above friction element. The dielectric layer of the same medium showed an insular distribution of positive static charge with individual charged islets ranging from 1 to 300 μ in maximum size.

As shown in Table 3, the record obtained with the medium was quite satisfactory with minima of dropout and flare.

REFERENCE EXAMPLE III-1

Electrostatic Recording Media III-A and III-B were respectively used without prior friction treatment. Electron microscopy of each medium revealed no region of static charge on the surface of the dielectric layer. As apparent from Table 3, the records obtained with these two media showed dropout and flare, with the dropout being particularly pronounced.

EXAMPLE III-4 AND REFERENCE EXAMPLE III-2

Electrostatic Recording Media III-A and III-B were respectively rubbed with a polystyrene roll having a diameter of 100 mm (2 kg). The static charge on Electrostatic Recording Medium III-A was positive and showed an insular pattern, with many charged islets measuring more than 300 μ in maximum size. The recording characteristics of this medium were fairly satisfactory with a minimum of dropout although the flare was somewhat remarkable (Example III-4). The static charge on Electrostatic Recording Medium III-B was negative and showed an insular pattern with many of charged islets exceeding 300 μ in maximum size. As apparent from Table 3, the record was unsatisfactory, showing many dropouts, owing to the fact that the polarity of the surface charge was the same as that of the recording charge (Reference Example III-2).

EXAMPLE III-5

Electrostatic Recording Medium III-A was rubbed with an aluminum roll having a diameter of 100 mm (2 kg). The resulting static charge was positive and showed an insular distribution with many charged islets exceeding 300 μ in maximum size. As apparent from Table 3, the record showed an improvement in dropout despite a fair frequency of flare. However, the recording characteristics were almost satisfactory.

TABLE 3

| | | Dropout (mm/m) | Flare (abnormal dots/m) |
|---|---|---|---|
| Example | III-1 | 8 | 40 |
| Example | III-2 | 10 | 39 |
| Example | III-3 | 7 | 39 |
| Reference Example | III-1 | | |
| Medium A | | 49 | 57 |
| Medium B | | 53 | 48 |
| Example | III-4 | 9 | 101 |
| Reference Example | III-2 | 55 | 53 |
| Example | III-5 | 7 | 110 |

EXAMPLE IV

EXAMPLE IV-1

Fabrication of the recording medium:

To a wood-free paper weighting 53 g/m$^2$ was coated with a cationic high molecular weight electrolyte (trade name: Chemistat 6300, Sanyo Chemical Industries) in an amount of 3 g/m$^2$ on the face side and in an amount of 2 g/m$^2$ on the reverse side, both on a dry basis to provide an electroconductive support. To this electroconductive support was applied the following dielectric coating composition in an amount of 4 g/m$^2$ on a dry basis and dried to give an electrostatic recording medium.

| | |
|---|---|
| Methyl ethyl ketone | 200 Parts |
| Amorphous silica powder (particle size 3μ) | 20 Parts |
| Polymethyl methacrylate | 60 Parts |
| Polybutyl methacrylate | 20 Parts |

The above medium was subjected to a polarity test. Also the above recording medium was rubbed to form a static charge and a recording test was carried out.

Polarity test

The dielectric layer of the electrostatic recording medium was rubbed 20 times with a polystyrene roll (friction element) and the polarity of the surface charge was tested with a surface potentiometer.

Formation of a static charge on the dielectric layer

On a glass plate was placed the electrostatic recording medium with its dielectric layer up and the surface of the dielectric layer was rubbed with a polystyrene roll (friction element) under the dead weight of the roll (2 kg) (pressure 260 g/cm$^2$, contact width 3 mm) at a rubbing speed of 10 m/min to form a static charge on the surface. This static charge was positive in polarity and showed an insular distribution of charged islets with a large majority of the islets ranging from 1 to 300 μ in maximum size.

Recording test

One-dot fine-line recording was carried out using Matsushita Graphic Commumication Systems' electrostatic plotter EP-101Al (the latent image was produced by applying a negative voltage to the pin electrode) and the total length (mm) of dropout and the number of flare dots per 100 cm were respectively counted. The results are shown in Table 4.

EXAMPLE IV-2

Fabrication of the recording medium:

A recording medium was fabricated using the following dielectric coating composition under otherwise the same conditions as Example IV-1.

| | |
|---|---|
| Methyl ethyl ketone | 200 Parts |
| Amorphous silica powder (particle size 3μ) | 20 Parts |
| Polymethyl methacrylate | 80 Parts |

This recording medium was subjected to the polarity test, frictional formation of a static charge on its dielectric layer, and recording test in the same manner as Example IV-1. The results are shown in Table 4.

The static charge produced on the dielectric layer by the friction treatment was positive in polarity and showed an insular distribution with a large majority of the charged islets exceeding 300 μ in maximum size.

REFERENCE EXAMPLE IV-1

Fabrication of the recording medium:

A recording medium was fabricated using the following dielectric coating composition under otherwise the same conditions as Example IV-1.

| | |
|---|---|
| Methyl ethyl ketone | 200 Parts |
| Amorphous silica powder (Particle size 3μ) | 20 Parts |
| Polybutyl methacrylate | 80 Parts |

This recording medium was subjected to the polarity test, frictional formation of a static charge on its dielectric layer, and recording test in the same manner as Example IV-1. The results are shown in Table 4.

The static charge produced on the dielectric layer by the friction treatment was negative in polarity and showed an insular distribution with a large majority of the charged islets measuring 1 to 300 μ in maximum size.

REFERENCE EXAMPLE IV-2

The recording medium of Example IV-1 was subjected to the recording test in the same manner except that the frictional formation of a static charge on its dielectric layer was omitted. The results are shown in Table 4.

TABLE 4

| | | Dropout (mm/m) | Flare (abnormal dots/m) |
|---|---|---|---|
| Example | IV-1 | 11 | 50 |
| Example | IV-2 | 13 | 240 |
| Reference Example | IV-1 | 55 | 140 |
| Reference Example | IV-2 | 61 | 120 |

It is apparent from Table 4 that when the dielectric layer contains both a resin adapted to be positively charged on friction and a resin adapted to be negatively charged on friction and carries an insular distribution of charged islets sized 1 to 300 μ in maximum size and having a polarity opposite to the static charge to be applied for image formation (Example IV-1), the resulting record is quite satisfactory with minima of dropout and flare. It is also seen that when the dielectric layer contains only a resin adapted to be positively charged on friction, the aforesaid charged islets exceed 300 μ in maximum size and the flare is remarkable but still the frequency of dropout is low (Example IV-2).

In contrast, when the dielectric layer comprises a resin adapted to be charged to the same polarity as the static charge to be applied for image formation (Reference Example IV-1), the incidence of dropout was high and, in addition, fog (slight coloration of the background) was also found. The incidence of dropout was also high when the dielectric layer was not previously charged (Reference Example IV-2).

EXAMPLE V

The electroconductive supports prepared in the same manner as in Example I were used in the following examples and reference examples.

EXAMPLE V-1

To the electroconductive support was applied a dielectric coating composition prepared by mixing amorphous silica powder having an average particle size of 8 μ, calcined clay powder having an average particle size of 0.8 μ, and a methyl methacrylate-ethyl acrylate (1:1) copolymer in a weight ratio of 0.5:3:6.5 in an amount of 5 g/m$^2$ on a dry basis to provide an electrostatic recording medium.

On a glass plate was placed the above electrostatic recording medium with its dielectric layer up and the surface of the dielectric layer was rubbed with a polystyrene roll under the dead weight of the roll (pressure 260 g/cm$^2$, contact width 3 mm) at a drawing speed of 10 m/min to impart a positive charge to the surface projections. Electron microscopy revealed that the surface had 20 projections in the equivalent diameter range of 5 to 15 μ per mm$^2$, with round dots indicative of positive static electricity being observed at 12 of these projections. The other projections were invariably less than 5 μ in equivalent diameter and free of electrification. In connection with these projections, there were two peak values in equivalent diameter distribution, one being 10 μ and the other being 1.5 μ.

Using the electrostatic recording medium thus treated for the formation of a surface charge, one-dot recording of a 1-meter-long fine line was carried out with Matsushita Graphic Communication System Inc's electrostatic plotter EP-101 Al. The length of dropouts and the number of flare dots are shown in Table 5.

EXAMPLE V-2

To the electroconductive support was applied a dielectric coating composition prepared by mixing 10 parts of calcium charbonate powder having an average particle size of 6 μ, 40 parts of calcium carbonate powder with an average particle size of 1 μ and 50 parts of methyl methacrylate-ethyl acrylate (1:1) copolymer in an amount of 5 g/m$^2$ on a dry basis to form a dielectric layer.

Prior to recording, this electrostatic recording medium was treated in the same manner as Example V-1 to impart a positive static charge to the projections on the dielectric layer. Electron microscopic observation of the dielectric layer of this electrostatic recording medium revealed 30 projections measuring 5 μ to 15 μ in equivalent diameter per mm$^2$ (peak value in equivalent diameter distribution = 8 μ) and round dots indicative of positive static electrocity at 23 of said projections. The other projections are smaller and less than 5 μ in equivalent diameter (peak value in equivalent diameter distribution = 1.7 μ) and free of electrification.

Using the electrostatic recording medium thus treated for formation of a static charge, recording was performed in the same manner as Example V-1. The length of dropouts and the number of flare dots per meter are shown in Table 5.

EXAMPLE V-3

To the electroconductive support was applied a coating composition prepared by admixing amorphous silica having an average particle size of 8 μ, calcined clay having an average particle size of 0.8 μ and a methyl methacrylate-ethyl acrylate (1:1) copolymer in a weight ratio of 0.1:3:6.9 in an amount of 5 g/m$^2$ on a dry basis to form a dielectric layer. Friction treatment was conducted in the same manner as in Example V-1. Electron microscopic examination of the dielectric layer of the above electrostatic recording medium for the condition of static charge revealed 2 projections 5 to 15 μ in equivalent diameter per mm$^2$ (peak value in equivalent diameter distribution = 10μ), with 2 of them being positively charged. Additionally, the regions having projections less than 5 μ in equivalent diameter (peak value in equivalent diameter distribution = 1.5 μ) were widely charged in a pattern of islets having a maximum size exceeding 300 μ.

Using this electrostatic recording medium, recording was carried out in the same manner as in Example V-1. The length of dropouts and the number of flare dots in the resulting record are shown in Table 5.

REFERENCE EXAMPLE V-1

The recording medium of Example V-2 was subjected to the recording test in the same manner except that the frictional formation of a static charge on its dielectric layer was omitted. The reuslts are shown in Table 5.

TABLE 5

| | | Dropout (mm/m) | Flare (abnormal dots/m) | Recording characteristics |
|---|---|---|---|---|
| Example | V-1 | 5 | 20 | Good |
| Example | V-2 | 3 | 40 | Good |
| Example | V-3 | 30 | 50 | Slightly inferior in solid black image homogienity |
| Reference Example | V-1 | 45 | 40 | Good |

It is apparent from the above results that when the dielectric layer having projections 5 to 15 μ in equivalent diameter in a density of at least 5 projections per mm$^2$ for the provision of a gap between the recording electrode and the surface of the dielectric layer as well as other smaller projections adapted not to contact the recording electrode due to the gap is previously treated for the formation of a static charge having a polarity opposite to that of the recording charge, the incidences of dropout and flare are very low in the recording of a fine line of one dot recording and, in addition, the homogeniety of a solid black image is also obtained.

EXAMPLE VI

EXAMPLE VI-1

Fabrication of Electrostatic Recording Medium VI-A

To the surface of a wood-free paper weighing 53 g/m$^2$ was applied a cationic high molecular weight electrolyte (trade name: Chemistat 6300, Sanyo Chemical Industries) in an amount of 3 g/m$^2$ on the face side and in an amount of 2 g/m$^2$ on the reverse side, both on a dry basis, to provide a conductive support. To the face side surface of this conductive support was further applied the following dielectric coating composition in an amount of 5 g/m$^2$ on a dry basis, followed by drying, to provide an electrostatic recording medium.

| | |
|---|---|
| Styrene-methyl methacrylate copolymer | 50 Parts |

-continued

| | |
|---|---|
| Calcium carbonate powder (Particle size 4μ) | 50 Parts |
| Toluene | 200 Parts |
| Di-2-ethylhexyl adipate (Sekisui Chemical: DOA) | 5 parts |

In the solvent were dispersed and dissolved the pigment and oleaginous substance (DOA) and, then, the resin was dissolved therein to provide a dielectric coating composition.

EXAMPLE VI-2

Fabrication of Electrostatic Recording Medium VI-B:

A recording medium was fabricated using the following dielectric coating composition under otherwise the same conditions as used for Electrostatic Recording Medium VI-A.

| | |
|---|---|
| Polymethyl methacrylate | 45 Parts |
| Polybutyl methacrylate | 15 Parts |
| Calcium carbonate powder (Particle size 4μ) | 40 Parts |
| Toluene | 200 Parts |
| Diisodecyl phthalate (Sekisui Chemical: DIDP) | 5 Parts |

EXAMPLE VI-3

On a glass plate was placed Electrostatic Recording Medium VI-B with its dielectric layer up and the surface of the dielectric layer was rubbed with a polystyrene roll having a diameter of 100 mm under the dead weight of the roll (2 kg) (pressure 260 g/cm$^2$, contact width 3 mm) at a speed of 10 m/min to form a positive static charge.

The formation of this static charge on friction treatment was confirmed by electron microscopy with Japan Electronics' JSM-T-300 based on the secondary electron image at the accelerating voltage of 2 KV. The static charge showed an insular distribution of positive static charge with charged islets measuring 1 to 300 μ in maximum size.

EXAMPLE VI-4

Fabrication of Electrostatic Recording Medium VI-C

An electrostatic recording medium was fabricated using the following dielectric coating composition under otherwise the same conditions as used for Electrostatic Recording Medium VI-A.

| | |
|---|---|
| Methyl methacrylate-ethyl acrylate copolymer | 40 parts |
| Polybutyl methacrylate | 20 parts |
| Calcium carbonate powder (Particle size 4μ) | 40 parts |
| Toluene | 200 parts |
| Dibenzyltoluene | 5 parts |

REFERENCE EXAMPLE VI-1

Fabrication of Electrostatic Recording Medium VI-D

An electrostatic recording medium was fabricated in the same manner as Electrostatic Recording Medium VI-A except that di-2-ethylhexyl adipate was omitted from the dielectric coating composition.

REFERENCE EXAMPLE VI-2

Fabrication of Electrostatic Recording Medium VI-E

An electrostatic recording medium was fabricated in the same manner as Electrostatic Recording Medium VI-B except that diisodecyl phthalate was omitted from the dielectric coating composition.

REFERENCE EXAMPLE VI-3

Fabrication of Electrostatic Recording Medium VI-F

An electrostatic recording medium was fabricated in the same manner as Electrostatic Recording Medium VI-C except that dibenzyltoluene was omitted from the dielectric coating composition.

The above recording media were subjected to the recording test using Matsushita Graphic Communication System Inc's CAD electrostatic plotter EP-101 Al by applying a negative voltage to the pin electrode. The results are shown in Table 6.

TABLE 6

| | | Dropout (mm/m) | Flare (abnormal dots/m) |
|---|---|---|---|
| Example | VI-1 | 17 | 41 |
| Example | VI-2 | 12 | 42 |
| Example | VI-3 | 8 | 36 |
| Example | VI-4 | 15 | 46 |
| Reference Example | VI-1 | 60 | 61 |
| Reference Example | VI-2 | 52 | 59 |
| Reference Example | VI-3 | 57 | 53 |

In Examples VI-1 through 4 of the invention, satisfactory records were obtained with minima of dropout and flare. Particularly, Example VI-3 wherein the surface of the dielectric layer containing an oleaginous substance was charged to a polarity opposite to that of the recording charge yielded a record substantially free of dropout.

In contrast, Reference Examples VI-1 through 3 wherein no oleaginous substance was incorporated yielded poor records with fairly high incidences of dropout and flare.

What is claimed is:

1. A process for producing an image of an electrostatic recording medium consisting of an electroconductive support and a dielectric layer formed on the support and containing an insulating resin and a pigment, comprising the steps of forming on the dielectric layer a surface static charge of a polarity opposite to that of a charge to be applied for image formation, applying a charge for image formation to form a latent image and developing the latent image with a toner.

2. A process according to claim 1 wherein said static charge of a polarity opposite to that of the charge to be applied for image formation is in an insular distribution with charged islets ranging from about 1 to 300 μ in maximum size.

3. A process according to claim 2 wherein said islets range from about 5 μ to about 100 μ in maximum size.

4. A process according to claim 1 wherein said static charge of a polarity opposite to that of the charge to be applied for image formation is formed by friction with an insulating substance and a conductive substance.

5. A process according to claim 4 wherein the insulating substance is a thermoplastic resin selected from the group consisting of polyethylene, polypropylene, polystyrene, polyvinyl butyral, polyvinyl acetate, polyester, polyvinyl chloride, polyacrylate, polyether and a copolymer of the copolymerizable monomers constituting these polymers, or a thermosetting resin selected from the group consisting of melamine-formaldehyde resin, ureaformaldehyde resin, phenol-formaldehyde resin and epoxy resin.

6. A process according to claim 4 wherein the conductive substance is a high molecular weight electrolyte, anionic, nonionic, cationic or amphoteric surfactant or semiconductive metal oxide powder.

7. A process according to claim 4 wherein said static charge is formed by friction with a mixture of the insulating substance and conductive substance.

8. A process according to claim 1 wherein said charge of a polarity opposite to that of the static charge to be applied for image formation is formed either by rubbing the surface of said dielectric layer with a substance capable of charging the surface positively and a substance capable of charging it negatively each at least once or by rubbing the dielectric layer with a mixture of said substances or a substance having a moiety capable of charging the surface positively and a moiety capable of charging it negatively at least once.

9. A process according to claim 1 wherein said insulating resin of the dielectric layer comprises at least one resin adapted to be positively charged on friction with a friction material and at least one resin adapted to be negatively charged on friction with the friction material and said static charge of a polarity opposite to that of the charge to be applied for image formation is formed by rubbing the surface of said dielectric layer with the friction material.

10. A process according to claim 9 wherein said friction material is selected from the group consisting of polyethylene resin, polypropylene resin, polystyrene resin, polyether resin, polyvinyl chloride resin, polymethyl methacrylate resin, melamineformaldehyde resin, urea-formaldehyde resin, urea-melamine resin, benzoguanamine resin, phenolic resin, epoxy resin, imide resin, styrene-acrylic lower alkyl ester copolymer resin, styrene-methacrylic lower alkyl ester copolymer resin, and mixtures thereof.

11. A process according to claim 1 wherein the surface of said dielectric layer is provided with a plurality of projections ranging from about 5 $\mu$ to about 15 $\mu$ in equivalent diameter and adapted to provide a gap between the surface of said dielectric layer and the recording electrode of an electrostatic recording system in a density of at least 5 projections per $mm^2$ as well as smaller projections adapted not to contact the recording electrode due to said gap.

12. A process according to claim 11 wherein said projections ranging from about 5 $\mu$ to about 15 $\mu$ in equivalent diameter are distributed in the density of 5 to 200 per $mm^2$.

13. A process according to claim 11 wherein the projections have two peak values in equivalent diameter distribution, one existing in the range of from about 5 to about 15 $\mu$ and the other existing in the range of about 0.3 to about 3 $\mu$.

14. A process according to claim 11 wherein the dielectric layer contains a pigment having an average particle size of not less than 3 $\mu$ but not more than 10 $\mu$ in combination with a pigment having an average particle size of not less than 0.1 $\mu$ but less than 3 $\mu$.

15. A process according to claim 1, wherein said dielectric layer contains an oleaginous substance having a volume resistivity of not less than $10^8$ $\Omega$·cm and a boiling point of not less than 250° C.

16. A process according to claim 15 wherein said oleaginous substance is selected from the group consisting of phthalic esters, aliphatic dibasic acid esters, fatty acid esters, epoxy compounds, phosphoric esters, polyesters, alkyl-substituted biphenyls, alkyl- or alkenyl-substituted naphthalenes, alkyl-substituted tetralins, mono- and di-benzyltoluenes, saturated hydrocarbons and ethers, each having a volume resistivity of not less than $10^8$ $\Omega$·cm and a boiling point of not less than 250° C.

17. A process according to claim 15 wherein said oleaginous substance is contained in a proportion of 0.1 to 20 parts by weight per 100 parts by weight of the solid content of said dielectric layer.

18. A process according to claim 15 wherein said oleaginous substance is contained in a proportion of 1 to 10 parts by weight per 100 parts by weight of the solid content of said dielectric layer.

19. A process according to claim 15 wherein said oleaginous substance is contained in a proportion of 2 to 6 parts by weight per 100 parts by weight of the solid content of said dielectric layer.

* * * * *